US006257508B1

(12) United States Patent
Wieczorek et al.

(10) Patent No.: US 6,257,508 B1
(45) Date of Patent: Jul. 10, 2001

(54) FUEL INJECTOR HAVING AFTER-INJECTION REDUCTION ARRANGEMENT

(75) Inventors: David P. Wieczorek, Seaford; James Paul Fochtman, Williamsburg, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/482,059

(22) Filed: Jan. 13, 2000

Related U.S. Application Data

(63) Continuation-in-part of application No. 09/259,168, filed on Feb. 26, 1999, now Pat. No. 6,039,272, which is a continuation of application No. 08/795,672, filed on Feb. 6, 1997, now Pat. No. 5,875,972.

(51) Int. Cl.[7] ..... F02M 47/02

(52) U.S. Cl. ..... 239/533.8; 239/533.9; 239/533.15; 239/585.4; 251/129.21

(58) Field of Search ..... 239/585.1–585.5, 239/533.8, 533.9, 533.15, 533.1, 533.2, 533.3; 251/129.21, 129.18, 129.15, 282

(56) References Cited

U.S. PATENT DOCUMENTS

| | | | |
|---|---|---|---|
| 2,273,830 | 2/1942 | Brierly et al. | 29/157 |
| 4,120,456 | 10/1978 | Kimura et al. | 239/464 |
| 4,643,359 | 2/1987 | Casey | 239/585 |

(List continued on next page.)

FOREIGN PATENT DOCUMENTS

| | | |
|---|---|---|
| 2 140 626 | 4/1984 | (GB) . |
| 0241973 | 9/1990 | (JP) . |
| WO 09910649 A1 | 3/1999 | (WO) . |
| WO 99/10648 | 3/1999 | (WO) . |
| WO 9910649 | 3/1999 | (WO) . |

OTHER PUBLICATIONS

*Geometrical Effects on Flow Characteristics of Gasoline High Pressure Direct Injecter*, W.M. Ren, J. Shen, J.F. Nally, Jr., p. 1–7, (97FL–95).

*Primary Examiner*—Patrick Brinson
*Assistant Examiner*—Dinh Q Nguyen

(57) ABSTRACT

The present invention provides a valve assembly including a housing, an armature, an armature bias spring, a needle, and a seat. The valve assembly housing has an inlet, an outlet, and an axially extending passageway from the inlet to the outlet along a longitudinal axis. The armature is disposed within the passageway. The armature has an armature passage including a first portion and a second portion. The first portion has a first cross-sectional area. The second portion has a second cross-sectional area. The first cross-sectional area of the first portion is greater than the second cross-sectional area of the second portion. The armature bias spring is disposed within the first portion of the armature passage. The needle is disposed within the second portion of the armature passage. The seat is located proximate the outlet. The flow restrictor is disposed between the first portion and the second portion of the armature passage of the armature. The flow restrictor includes an orifice having a third cross-sectional area that is less than the first cross-sectional area. The present invention also provides a method of generating flow from a valve assembly without after-flow through the valve assembly when the valve assembly is commanded to terminate a flow cycle. The method is achieved by sizing the first portion of the armature passage with a first volume and the second portion of the armature passage with a second volume, which is less than the first volume; providing a first vent aperture that communicates the first volume with a portion of the armature passageway; providing a second vent aperture that communicates the second volume with a portion of the armature passageway; and locating a flow restrictor between the first volume and the second volume.

20 Claims, 2 Drawing Sheets

U.S. PATENT DOCUMENTS

| | | | | |
|---|---|---|---|---|
| 5,114,077 | | 5/1992 | Cerny | 239/483 |
| 5,170,987 | * | 12/1992 | Krauss et al. | 251/129.21 |
| 5,207,384 | | 5/1993 | Horsting | 239/463 |
| 5,271,563 | | 12/1993 | Cerny | 239/533.2 |
| 5,284,302 | | 2/1994 | Kato et al. | 239/585.1 |
| 5,288,025 | | 2/1994 | Cerny | 239/533.8 |
| 5,409,169 | | 4/1995 | Saikalis et al. | 239/404 |
| 5,462,231 | | 10/1995 | Hall | 239/585.4 |
| 5,494,224 | | 2/1996 | Hall et al. | 239/585.5 |
| 5,566,920 | * | 10/1996 | Romann et al. | 239/585.4 |
| 5,625,946 | | 5/1997 | Wildeson et al. | 29/888.41 |
| 5,630,400 | | 5/1997 | Sumida et al. | 123/470 |
| 5,636,796 | | 6/1997 | Oguma | 239/533.12 |
| 5,871,157 | | 2/1999 | Fukutomi et al. | 239/463 |
| 5,875,972 | * | 3/1999 | Ren et al. | 239/585.4 |
| 5,961,052 | | 10/1999 | Coldren et al. | 239/585.1 |

* cited by examiner

FUEL INJECTOR HAVING AFTER-INJECTION REDUCTION ARRANGEMENT

CROSS-REFERENCE TO RELATED APPLICATIONS

This application is a continuation-in-part of U.S. application Ser. No. 09/259,168, filed Feb. 26, 1999, now U.S. Pat. No. 6,039,272; which is a continuation application of U.S. application Ser. No. 08/795,672, filed Feb. 6, 1997, now U.S. Pat. No. 5,875,972. This application claims the right of priority to each of the prior applications. Furthermore, each of the prior applications is hereby in their entirety incorporated by reference.

BACKGROUND OF THE INVENTION

This invention relates in general to valve assemblies, and, in particular, fuel injectors having a swirl generator. More particularly to high-pressure, direct-injection fuel injectors required to meter accurate and repeatable amounts of fuel for any given injection pulse.

A high-pressure, direct-injection fuel injector is described in the above referenced applications. The fuel injector has a needle reciprocated within a fuel passageway by an armature. The armature is moved by electromagnetic force created by current that flows through a coil assembly located proximate the armature. When the electromagnetic force acts on the armature and operatively connected needle, the armature and needle overcome the load of an armature spring to lift the needle from a seat, which opens the outlet of the fuel injector to begin an injection cycle. To terminate the fuel injection cycle, the electromagnetic force is decayed and held constant until the armature and needle begin to move in the direction of the seat. When the needle fully engages the seat, the outlet of the fuel injection closes, and the injection cycle is completed.

Under certain conditions, however, the needle can rebound (bounce) when it contacts the seat. Because the needle rebounds and fails to fully engage the seat, additional fuel can be injected from the fuel outlet after the desired fuel injection cycle. That is, the valve assembly, which forms the fuel injector, allows for after-flow through the valve assembly when the valve assembly is commanded to terminate a flow cycle. In particular, the fuel injector produces after-injections, which are injections of fuel from the outlet of the fuel injector after the specified injection cycle should have terminated. During particular operative conditions, the needle can rebound numerous times, and create multiple after-injections. These multiple after-injections can reestablish injection fuel flow during the fuel outlet closing procedure. This addition fuel flow deters arcuate fuel injection calibration, which affects subsequent engine calibration. Moreover, the undesired fuel flow minimizes the ability to achieve a linear flow range (LFR) for the fuel injector.

SUMMARY OF THE INVENTION

The present invention provides a valve assembly including a housing, an armature, an armature bias spring, a needle, a seat, and a flow restrictor. The housing has an inlet, an outlet, and a passageway extending from the inlet to the outlet along a longitudinal axis. The armature is disposed within the passageway. The armature has an armature passage including a first portion and a second portion. The first portion has a first cross-sectional area. The second portion has a second cross-sectional area. The first cross-sectional area of the first portion is greater than the second cross-sectional area of the second portion.

The armature bias spring is disposed within the first portion of the armature passage. The needle is disposed within the second portion of the armature passage. The seat is located proximate the outlet. The flow restrictor is disposed between the first portion and the second portion of the armature passage of the armature. The flow restrictor includes an orifice having a third cross-sectional area that is less than the first cross-sectional area.

In a preferred embodiment, the armature is a substantially cylindrical member that has a first end surface, a second end surface, and a plurality of sections between the first surface and the second surface that provides a side surface with a stepped profile so that the diameter of the substantially cylindrical member decreases between the first surface and the second surface. The first portion of the armature passage extends from the first surface into the plurality of sections and the second portion of the armature passage extends from the second surface into the plurality of sections so that the first portion and the second portion of the armature passage engage at a transition region.

The first portion of the armature passage has a first vent aperture that communicates the first portion with the side surface, and the second portion of the fuel passage has a second vent aperture that communicates the second portion with the side surface. In a preferred embodiment, each of the first portion, second portion, the first vent aperture, and the second vent aperture is a substantially cylindrical volume. The substantially cylindrical volume of the first portion has a diameter D1. The substantially cylindrical volume of the second portion has a diameter D2, which is approximately 50% less than the diameter D1. The first vent aperture comprise a diameter D3, which is approximately 75% less than the diameter D1. The second vent aperture comprises a diameter D4, which is approximately 60% less than the diameter D1. The orifice of the flow restrictor has a substantially circular cross-section with a diameter D5, which is approximately 80% less than the diameter D1.

The present invention also provides a fuel injector including a housing, an armature, an armature bias spring, a needle, a seat, a swirl generator, and a flow restrictor. The fuel injector housing has a fuel inlet, a fuel outlet, and an axially extending fuel passageway from the fuel inlet to the fuel outlet along a longitudinal axis. The armature is disposed within the fuel passageway. The armature has an armature passage including a first portion and a second portion. The first portion is a first cylindrical volume with a first diameter, and the second portion being a second cylindrical volume with a second diameter. The first diameter is greater than the second diameter. The armature bias spring disposed within the first portion of the armature passage. The needle is disposed within the second portion of the armature passage. The seat is located proximate the fuel outlet, and the swirl generator is adjacent the seat. The flow restrictor is disposed between the first portion and the second portion of the armature passage. The flow restrictor includes a circular orifice with a third diameter, which is less than the second diameter.

In a preferred embodiment, the armature is a substantially cylindrical member having a first end surface, a second end surface, and a plurality of sections between the first end surface and the second end surface, the plurality of sections provides a side surface. The first portion of the armature passage has a first vent aperture that communicates the first portion with the side surface, and the second portion of the armature passage has a second vent aperture that communicates the second portion with the side surface. The preferred embodiment also has armature guide eyelet located at an inlet portion of the body. The armature guide eyelet is configured to allow fluid communication between the armature guide eyelet and the side surface of the armature.

The present invention also provides a method of generating flow from a valve assembly without allowing after-flow through the valve assembly when the valve assembly is commanded to terminate a flow cycle. The valve assembly includes a housing having an inlet, an outlet, and a passageway extending from the inlet to the outlet; an armature disposed within the passageway, the armature has an armature passage including a first portion and second portion; an armature bias spring disposed within the first portion of the armature passage; a needle disposed within the second portion of the armature passage; a seat located proximate the outlet. The method is achieved by sizing the first portion of the armature passage with a first volume and the second portion of the armature passage with a second volume, which is less than the first volume; providing a first vent aperture that communicates the first volume with a portion of the valve passageway; providing a second vent aperture that communicates the second volume with a portion of the valve passageway; and locating a flow restrictor between the first volume and the second volume.

In a preferred embodiment of the method, a fuel injector with a swirl generator is provided as the valve assembly so that the method includes generating flow from the fuel injector without after-injections when the fuel injector is commanded to terminate a fuel injecting cycle. A first cylinder is provided as the first volume, the first cylinder has a first diameter; a second cylinder is provided as the second volume, the second cylinder has a second diameter, which is less than the first diameter; and the flow restrictor is provided with a circular orifice, the circular orifice has a third diameter, which is less than the second diameter.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

Figure 1:
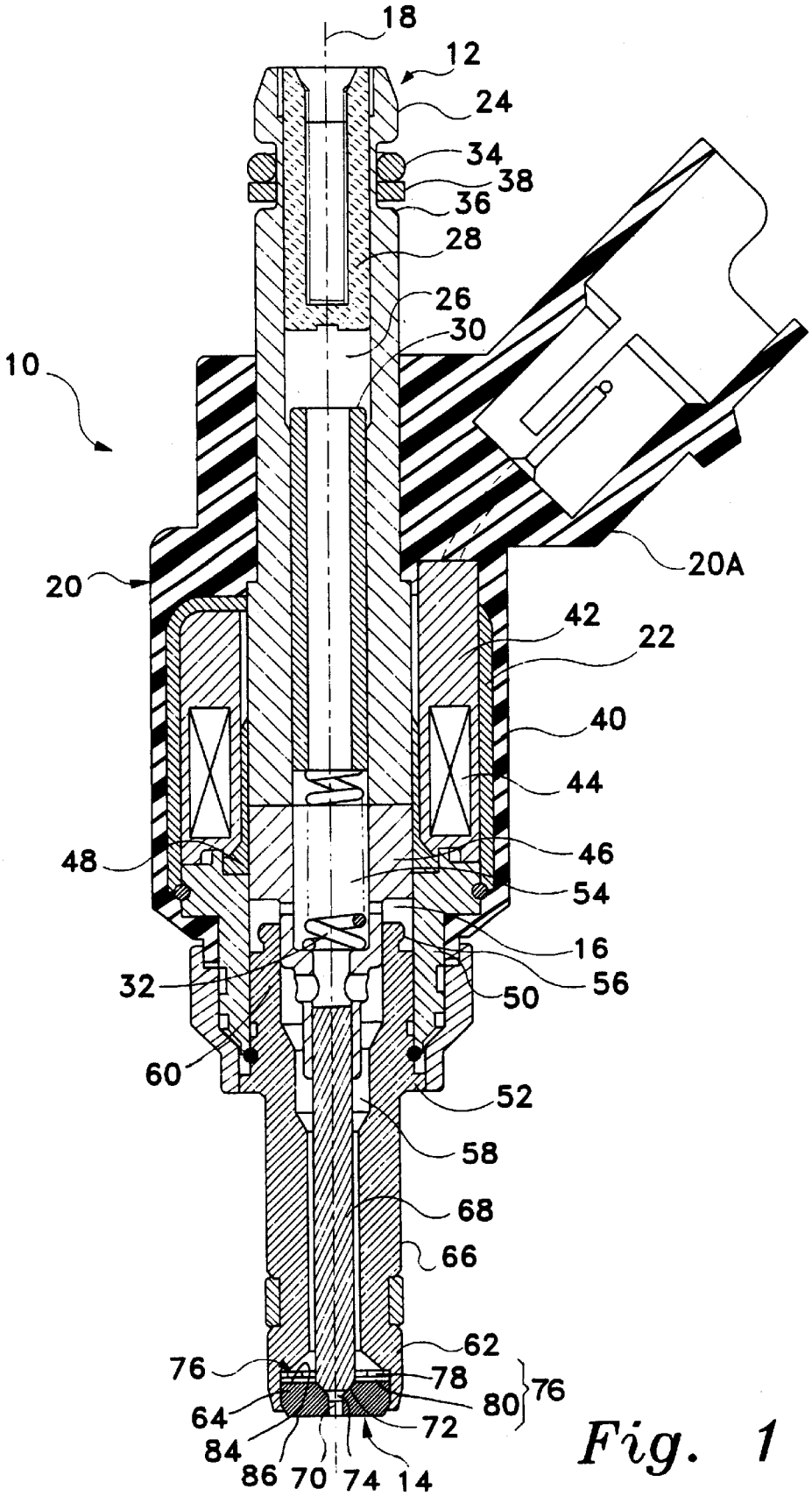
FIG. 1 is a cross-sectional view of a valve assembly, which is preferably a fuel injector, of the present invention taken along its longitudinal axis.

FIG. 1 illustrates a valve assembly of the present invention, which is, preferably, a high-pressure, direct-injection fuel injector. The fuel injector 10 has a housing, which includes a fuel inlet 12, a fuel outlet 14, and a fuel passageway 16 extending from the fuel inlet 12 to the fuel outlet 14 along a longitudinal axis 18. The housing has an over-molded plastic member 20 cincturing a metallic support member 22. A fuel inlet member 24 with an inlet passage 26 is disposed within the over-molded plastic member 20. The inlet passage 26 serves as part of the fuel passageway 16 of the fuel injector 10. A fuel filter 28 and an adjustable tube 30 is provided in the inlet passage 26. The adjustable tube 30 is positionable along the longitudinal axis 18 before being secured in place to vary the length of an armature bias spring 32, which controls the quantity of fluid flow exiting the fuel injector 10. The over-molded plastic member 20 also supports an electrical socket that receives a plug (not shown) to operatively connect the fuel injector 10 to an external source of electrical potential, such as an electronic control unit ECU (not shown). An elastomeric o-ring 34 is provided in a groove 36 on an exterior portion of the inlet member 24. The o-ring 36 is biased by a backing plug 38 to sealingly secure the inlet member 24 with a fuel supply member, such as a fuel rail (not shown).

The metallic support member 22 encloses a coil assembly 40. The coil assembly 40 includes a bobbin 42 that retains a coil 44. The ends of the coil assembly 40 are operatively connected to the electrical socket through the over-molded plastic member 20. An armature 46 is disposed within the fuel passageway 16, and is axially aligned with the inlet member 24 by a spacer 48, a body shell 50, and a body 52, The armature 46 has an armature passage 54 aligned along the longitudinal axis 18 with the inlet passage 26 of the inlet member 24. The spacer 48 engages the body 52, which is partially disposed within the body shell 50. An armature guide eyelet 56 is located on an inlet portion 60 of the body 52. The armature guide eyelet 56 is located at an inlet portion 60 of the body 52. The armature guide eyelet 56 is configured to allow fluid communication between the armature guide eyelet 56 and the armature 46.

An axially extending body passage 58 connects the inlet portion 60 of the body 52 with an outlet portion 62 of the body 52. The armature passage 54 of the armature 46 is axially aligned with the body passage 58 of the body 52 along the longitudinal axis 18. A seat 64, which is preferably a metallic material, is located at the outlet portion 62 of the body 52. The body 52 has a neck portion 66, which is, preferably, a cylindrical annulus that surrounds a needle 68. The needle 68 is operatively connected to the armature 46, and, in a preferred embodiment, is a substantially cylindrical needle. The cylindrical needle is centrally located within the cylindrical annulus. The cylindrical needle is axially aligned with the longitudinal axis 18 of the fuel injector 10.

The armature 46 is magnetically coupled to the inlet member 24 near the inlet portion 60 of the body 52. A portion of the inlet member 24 proximate the armature 46 serves as part of the magnetic circuit formed with the armature 46 and coil assembly 40. The armature 46 is guided in the armature guide eyelet 56 and is responsive to an electromagnetic force generated by the coil assembly 40, which axially reciprocates the armature 46 along the longitudinal axis 18 of the fuel injector 10. The electromagnetic force is generated by current flow from the ECU through the coil assembly 40. During operation of the fuel injector 10, the needle 68 engages the seat 64, which opens and closes a seat passage 70 of the seat 64 to permit or inhibit, respectively, fuel from exiting the fuel outlet 14 of the fuel injector 10. The needle 68 includes a curved surface, which is preferably a spherical surface, that mates with the conical end 72 of a funnel 74, which serves as the preferred seat passage 70 of the seat 64. The fuel to be injected from the fuel injector 10 flows in fluid communication from the fuel inlet source (not shown) through the fuel inlet 12 passage of the inlet member 24, the armature passage 54 of the armature 46, the body passage 58 of the body 52, and the seat passage 70 of the seat 64. The fuel is feed from the inlet source in an operative range approximately between 700 psi and 2000 psi.

A swirl generator 76 is located in the body passage 58 proximate the seat 64. The swirl generator 76 allows the fuel to form a swirl pattern on the seat 64. In particular, the fuel is swirled on the conical end 72 of the funnel 74 in order to produce a desired spray pattern. The swirl generator 76, preferably, is constructed from a pair of flat disks, a guide disk 78 and a swirl disk 80; however, various configurations of a swirl generator 76 could be employed. Further details of the guide disk 78 and the swirl 80 disk are described in the above referenced applications, which are incorporated by reference in their entirety.

The needle 68 is guided in a central aperture 82 of the guide disk 78. The guide disk 78 has a plurality of fuel passage openings that supply fuel from the body passage 58 to the swirl disk 80. The swirl disk 80 directs fuel from the fuel passage openings in the guide disk 78 and meters the flow of fuel tangentially toward the seat passage 70 of the seat 64. The guide and swirl disks 78, 80 that form the swirl generator 76 are secured to a first surface 84 of the seat 64, preferably, by laser welding. The first surface 84 of the seat 64 is directed toward the body passage 58 of the body 52, and a second surface 86 of the seat 64 is exposed to an exterior of the fuel injector 10. The first surface 84 is spaced from the second surface 86 a defined distance along the longitudinal axis 18 of the fuel injector 10.

Figure 2:
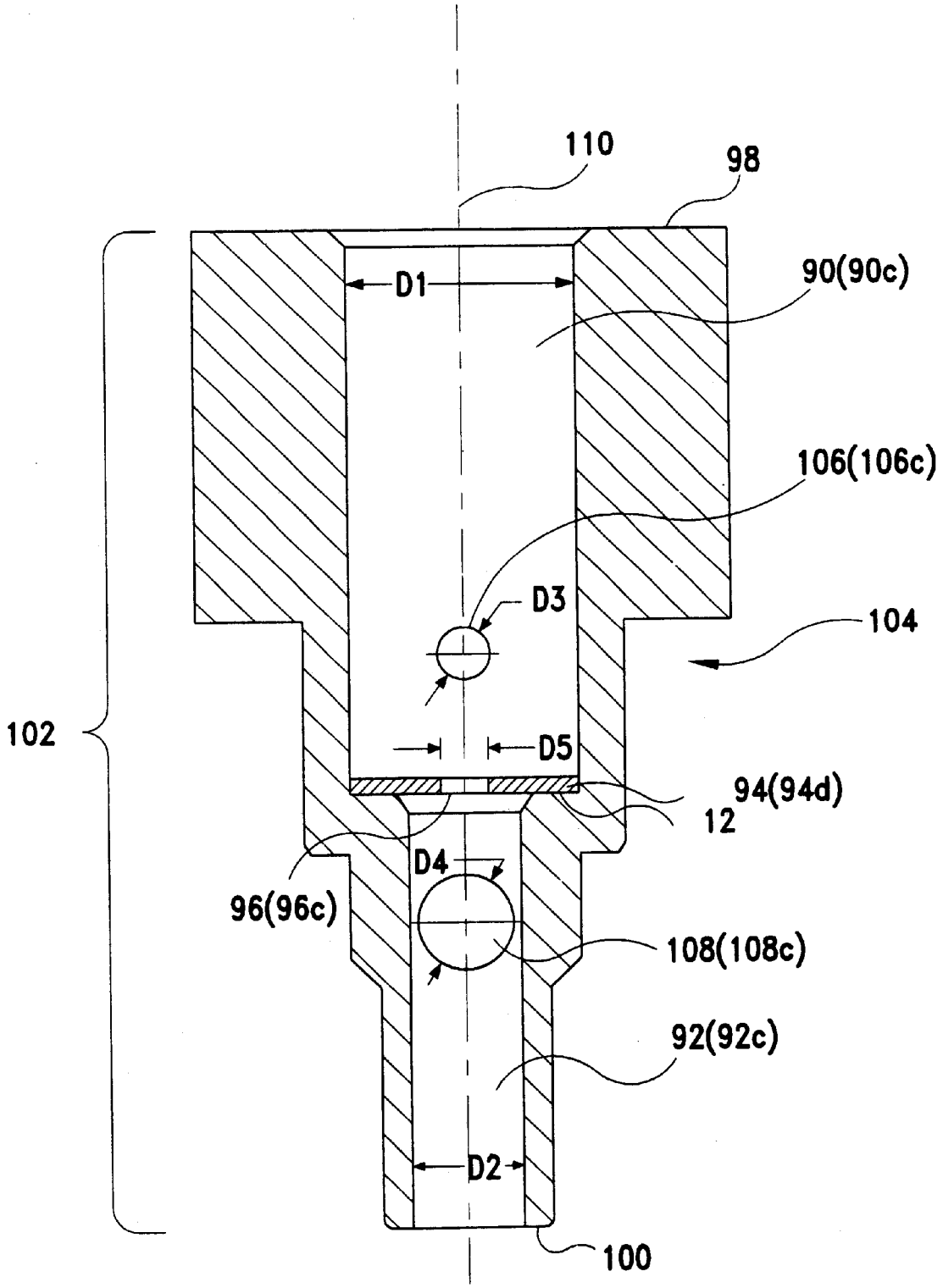
FIG. 2 is an enlarged cross-sectional view of the armature of the valve assembly shown in FIG. 1.

As shown in FIG. 2, the armature passage 54 of the armature 46 includes a first portion 90 and a second portion 92. The first portion 90 has a first cross-sectional area. The second portion 92 has a second cross-sectional area. The first cross-sectional area of the first portion 90 is greater than the second cross-sectional area of the second portion 92.

The armature bias spring 32 is disposed within the first portion 90 of the armature passage 54. The needle 68 is disposed within the second portion 92 of the of the armature passage 54. The seat 64 is located proximate the fuel outlet 14, and the swirl generator 76 is adjacent the seat 64. A flow restrictor 94 is disposed between the first portion 90 and the second portion 92 of the armature passage 54 of the armature 46. The flow restrictor 94 is, preferably, welded to the armature 46. The flow restrictor 94 includes an orifice 96 having a third cross-sectional area that is less than the first cross-sectional area.

In a preferred embodiment, the armature 46 is a substantially cylindrical member that has a first end surface 98, a second end surface 100, and a plurality of sections 102 between the first end surface 98 and the second end surface 100. The plurality of sections 102 provides a side surface 104 with a stepped profile so that the diameter of the substantially cylindrical member decreases between the first end surface 98 and the second end surface 100. The first portion 90 of the armature passage 54 extends from the first end surface 98 into the plurality of sections 102 and the second portion 92 of the armature passage 54 extends from the second end surface 100 into the plurality of sections 102 so that the first portion 90 and the second portion 92 of the armature passage 54 engage at a transition region.

The first portion 90 of the armature passage 54 has a first vent aperture 106 that communicates the first portion 90 with the side surface 104, and the second portion 92 of the fuel passage 54 has a second vent aperture 108 that communicates the second portion 92 with the side surface 104. In a preferred embodiment, each of the first portion 90, second portion 92, the first vent aperture 106, and the second vent aperture 108 has a substantially cylindrical volume. The first substantially cylindrical volume 90*c* of the first portion 90 receives the armature bias spring 32, which is, preferably a coil spring. The second substantially cylindrical volume 92*c* of the second portion 92 receives the needle 68, which is a cylindrical member. The first substantially cylindrical volume 90*c* of the first portion 90 has a diameter D1. The second substantially cylindrical volume 92*c* of the second portion 92 has a diameter D2, which is approximately 50% less than the diameter D1. The first vent aperture cylindrical valve 106*c* has a diameter D3, which is approximately 75% less than the diameter D1. The second vent aperture cylindrical valve 108*c* has a diameter D4, which is approximately 60% less than the diameter D1. The orifice 96 of the flow restrictor 94 has a substantially circular cross-section with a diameter D5. The diameter D5 of the circular orifice 96*c* is less than the diameter D2 of the second substantially cylindrical volume 92*c*, and is approximately 80% less than the diameter D1 of the first substantially cylindrical volume 90*c*.

The armature passage 54 has a central axis 110 that is substantially parallel to the longitudinal axis 18. The first vent aperture 106 and the second vent aperture 108 are transverse to the central axis 110. In a preferred embodiment, the first vent aperture 106 extends through the first portion 90 to diametrically opposed location on the side surface 104, and the second vent aperture 108 extends through the second portion 92 to diametrically opposed location on the side surface 104.

In the preferred embodiment, the plurality of sections 102 is four sections, and the first portion 90 of the armature passageway 54 extends from the first end surface 98 into two of the four sections and the second portion 92 of the armature passage 54 extends from the second end surface 100 into three of the four sections so that the first portion 90 and the second portion 92 of the armature passage 54 engages at a transition region. The second portion 92 of the armature passage 54 has a wall 112 proximate the first portion 90, and the flow restrictor 94 is, preferably, a flat disk 94*d* biased by the armature bias spring 32 against the wall 112.

Although a flat disk 94*d* is used as the flow restrictor 94 in the preferred embodiment, the flow restrictor 94 could be formed as an integral part of the armature 46. For example, the first portion 90 and the second portion 92 of the armature passage 54 could be arranged so that they are axially offset along the longitudinal axis 18 so that a solid section is formed between the first portion 90 and the second portion 92, and at least one orifice 96 could be disposed in the solid section that allows communication between the first portion 90 and the second portion 92. Moreover, it should be understood that the flow restrictor 94 can assume various forms, such as a disk or integral part of the armature 46, as long as the flow restrictor 94 limits the amount of flow that would communicate between the first portion 90 and the second portion 92 if the flow restrictor 94 was not present.

It is believed that restricting flow between the first portion 90 and the second portion 92 of the armature passage 54, allows for the needle 68 to engage the seat 68 without bouncing, and, thus, eliminates after-injections. By limiting flow from the second portion 92 to the first portion 90 during the injection cycle termination process, fluid momentum is transferred to the needle 68. This transferred momentum force is greatest during high velocity fuel flow through the fuel passageway 16, and reduces as the fuel outlet 14 of the injector is closed. The momentum forces couple with the force from the armature bias spring 32 acting on the armature 46 to engage the needle 68 with the seat 64 and close the seat passage 70. Also, it is believed that the relationship of the armature guide eyelet 56 and the side surface 104 of the armature 46 assists in engaging the needle 68 to the seat 64 without bouncing. That is, fluid in the body passage 58 is forced through the space between the armature guide eyelet 56 and the side surface 104 when the armature 46 and a needle 68 move toward the seat 64. As the moving armature 46 forces the fuel in the body passage 58 passed the space between the armature guide eyelet 56 and the side surface 104 of the armature 46, the fuel slows movement of the armature 46, and, thus slows the closing velocity of the needle 68 to avoid bouncing of the needle 68 when the needle 68 engages the seat 64.

Additionally, the first vent hole 104 and the second vent hole 106 allow fuel trapped in the body passage 58 and the portion of the fuel passageway 16 proximate the body shell 50 to be released through the armature passage 54 toward the fuel inlet 12. It is believed that the releasing of the trapped fluid also assists in engaging the needle 68 with the seat 64 without the needle 68 bounce. Moreover, the combination of the flow restrictor 94 between the first portion 90 and second portion 92 of the armature passage 54, the space relationship between the armature guide eyelet 56 and the side surface 104 of the armature 46, and the location of the first vent hole 104 and the second vent hole 106 are believed to provide and have experimentally shown, improvements in the linear flow range of the fuel injector.

The present invention also provides a method of generating flow from a valve assembly without after-flow through the valve assembly when the valve assembly is commanded to terminate a flow cycle. The valve assembly includes a housing having an inlet, outlet, and a passageway extending from the inlet to the outlet; an armature 46 disposed with in the passageway, the armature 46 has an armature passage 54 including a first,portion 90 and second portion 92; an armature bias spring 32 disposed within the first portion 90 of the armature passage 54; a needle 68 disposed within the second portion 92 of the of the armature passage 54; and a seat 64 located proximate the fuel outlet 14. The method is achieved by sizing the first portion 90 of the armature passage 54 with a first volume and the second portion 92 of the armature passage 54 with a second volume, which is less than the first volume; providing a first vent aperture 106 that communicate the first volume with a portion of the armature passageway; providing a second vent aperture 108 that communicates the second volume with a portion of the armature passageway; and locating a flow restrictor 94 between the first volume and the second volume.

In a preferred embodiment of the method, a fuel injector 10 with a swirl generator 76 is provided as the valve assembly so that the method includes generating flow from the fuel injector 10 without after-injections when the fuel injector 10 is commanded to terminate an injecting cycle. The first cylinder is provided as the first volume, the first cylinder 90*c* having a first diameter; a second cylinder is provided as the second volume, the second cylinder 92*c* has a second diameter that is less than the first diameter. The flow restrictor 94 provides a third volume. The third volume is less than the second volume. Preferably, the flow restrictor 94 has a circular orifice 96*c*, which has a third diameter, which is less than the second diameter.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What we claim is:

1. A valve assembly comprising:

a housing having an inlet, an outlet, and a passageway extending from the inlet to the outlet along a longitudinal axis;

an armature disposed within the passageway, the armature having an armature passage including a first portion and a second portion, the first portion having first cross-sectional area, the second portion having a second cross-sectional area, the first cross-sectional area being greater than the second cross-sectional area;

an armature bias spring disposed within the first portion of the armature passage;

a needle disposed within the second portion of the of the armature passage;

a seat proximate the outlet; and a flow restrictor disposed between the first portion and the second portion of the armature passage of the armature, the flow restrictor including an orifice having a third cross-sectional area, the third cross-sectional area being less than the armature cross-sectional area.

2. The valve assembly of claim 1, wherein the armature comprises a substantially cylindrical member having a first end surface, a second end surface, and a plurality of sections between the first surface and the second surface, the plurality of sections providing a side surface with a stepped profile so that the diameter of the substantially cylindrical member decreases between the first surface and the second surface.

3. The valve assembly of claim 2, wherein the first portion of the armature passage extends from the first surface into the plurality of sections and the second portion of the armature passage extends from the second surface into the plurality of sections so that the first portion and the second portion of the armature passage engage at a transition region.

4. The valve assembly of claim 3, wherein the first portion of the armature passage comprises a first vent aperture that communicates the first portion with the side surface; and wherein the second portion of the armature passage comprises a second vent aperture that communicates the second portion with the side surface.

5. The valve assembly of claim 4, wherein the fuel passage comprises a central axis that is substantially parallel to the longitudinal axis;

wherein the first vent aperture and the second vent aperture are transverse to the central axis;

wherein the first vent aperture extends through the first portion to diametrical opposed location on the side surface; and wherein the second vent aperture extends through the second portion to diametrically opposed location on the side surface.

6. The valve assembly of claim 5, wherein the first portion, the second portion, the first vent aperture, and the second vent aperture comprise a substantially cylindrical volume.

7. The valve assembly of claim 6, wherein the substantially cylindrical volume of the first portion comprises a diameter D1;

wherein the substantially cylindrical volume of the second portion comprises a diameter D2, which is approximately 50% less than the diameter D1;

wherein the first vent aperture comprise a diameter D3, which is approximately 75% less than the diameter D1; and wherein the second vent aperture comprises a diameter D4, which is approximately 60% less than the diameter D1.

8. The valve assembly of claim 7, wherein the orifice of the flow restrictor comprises a substantially circular cross-section having a diameter D5, which is approximately 80% less than the diameter D1.

9. The valve assembly of claim 8, wherein an armature guide eyelet is located at an inlet portion of the body, the armature guide eyelet configured to allow fluid communication between the armature guide eyelet and the side surface of the armature.

10. The valve assembly of claim 9, wherein the plurality of sections comprises four sections; and wherein the first portion of the armature passageway extends from the first surface into two of the four sections and the second portion of the armature passage extends from the second surface into three of the four sections so that the first portion and the second portion of the armature passage engage at a transition region.

11. The valve assembly of claim 10, wherein the second portion of the armature passage comprises a wall proximate the first passage; and wherein the flow restrictor comprises a flat disk biased by the armature spring against the wall.

12. The valve assembly of claim 11, wherein the armature spring comprises a coil spring.

13. The valve assembly of claim 12, wherein the housing comprises an over-molded plastic member cincturing a metallic support member and a body shell; and wherein a body extends from the body shell, the body having an inlet portion, an outlet that serves as the outlet of the valve assembly, and a body passage extending from the inlet portion to the outlet portion.

14. The valve assembly of claim 13, wherein the valve assembly comprises a fuel injector that injects fuel under pressure, the fuel pressure range is approximately between 700 psi and 2000 psi.

15. A fuel injector comprising:

a housing having a fuel inlet, a fuel outlet, and a fuel passageway extending from the fuel inlet to the fuel outlet along a longitudinal axis;

an armature disposed within the fuel passageway, the armature having a armature passage including a first portion and a second portion, the first portion being a first cylindrical volume with a first diameter, the second portion being a second cylindrical volume with a second diameter, the first diameter being greater than the second diameter, an armature bias spring disposed within the first portion of the armature passage;

a needle disposed within the second portion of the armature passage;

a seat proximate the fuel outlet;

a swirl generator adjacent the seat; and a flow restrictor disposed between the first portion and the second portion of the armature passage of the armature, the flow restrictor including a circular orifice with a third diameter, the third diameter being less than the second diameter.

16. The fuel injector of claim 15, wherein the armature comprises a substantially cylindrical member having a first end surface, a second end surface, and a plurality of sections between the first end surface and the second end surface, the plurality of sections providing a side surface.

17. The fuel injector of claim 16, wherein the first portion of the armature passage comprises a first vent aperture that communicates the first portion with the side surface, and wherein the second portion of the armature passage comprises a second vent aperture that communicates the second portion with the side surface.

18. The fuel injector of claim 17, wherein an armature guide eyelet is located at an inlet portion of a body, the armature guide eyelet configured to allow fluid communication between the armature guide eyelet and the side surface of the armature.

19. A method of generating flow from a valve assembly without after-flow through the valve assembly when the valve assembly is commanded to terminate a flow cycle, the valve assembly includes a housing having an inlet, an outlet, and a passageway extending from the inlet to the outlet; an armature disposed within the passageway, the armature having an armature passage including a first portion and second portion; an armature bias spring disposed within the first portion of the armature passage; a needle disposed within the second portion of the armature passage; and a seat proximate the outlet, the method comprising:

sizing the first portion of the armature passage with a first volume and the second portion of the fuel passage with a second volume, the second volume being less than the first volume;

providing a first vent aperture that communicate the first volume with a portion of the fuel passageway;

providing a second vent aperture that communicates the second volume with a portion of the fuel passageway;

locating a flow restrictor between the first volume and the second volume.

20. The method of claim 19, further comprising:

providing a fuel injector with a swirl generator as the valve assembly so that the method includes generating flow from the fuel injector without after-injections when the fuel injector is commanded to terminate an injecting cycle;

providing a first cylinder as the first volume, providing a second cylinder as the second volume, the second volume being less than the first volume, and providing the flow restrictor with an orifice, the orifice having a third volume, the third volume being less than the second volume.

* * * * *